US010781089B2

(12) United States Patent
Finkbeiner

(10) Patent No.: US 10,781,089 B2
(45) Date of Patent: Sep. 22, 2020

(54) LIFTING DEVICE, PARTICULARLY A MOBILE LIFTING DEVICE

(75) Inventor: Gerhard Finkbeiner, Freudenstadt (DE)

(73) Assignee: Gerhard Finkbeiner, Freundenstadt (DE)

( * ) Notice: Subject to any disclaimer, the term of this patent is extended or adjusted under 35 U.S.C. 154(b) by 1304 days.

(21) Appl. No.: 13/262,247

(22) PCT Filed: Mar. 30, 2010

(86) PCT No.: PCT/EP2010/002020
§ 371 (c)(1),
(2), (4) Date: Sep. 30, 2011

(87) PCT Pub. No.: WO2010/112200
PCT Pub. Date: Oct. 7, 2010

(65) Prior Publication Data

US 2012/0018688 A1 Jan. 26, 2012

(30) Foreign Application Priority Data

Mar. 30, 2009 (DE) ..... 10 2009 014 951

(51) Int. Cl.
*B66F 7/28* (2006.01)
*B66F 7/04* (2006.01)
(Continued)

(52) U.S. Cl.
CPC ..... *B66F 7/28* (2013.01); *B66F 3/08* (2013.01); *B66F 3/24* (2013.01); *B66F 3/42* (2013.01);
(Continued)

(58) Field of Classification Search
CPC ..... B66F 7/00; B66F 3/00; B66F 7/28; B66F 3/46; B66F 7/20; B66F 7/16; B66F 3/24; B66F 3/12
(Continued)

(56) References Cited

U.S. PATENT DOCUMENTS 2,926,888 A * 3/1960 Schultz ..... B66F 3/42 254/133 R
3,622,124 A * 11/1971 Sidles ..... B66F 3/42 254/3 R
(Continued)

FOREIGN PATENT DOCUMENTS

CA 2524462 4/2007
EP 1285878 2/2003
(Continued)

OTHER PUBLICATIONS

International Search report corresponding to International Application No. PCT/EP2010/002020, dated Jun. 22, 2010.
(Continued)

*Primary Examiner* — Orlando E Aviles
*Assistant Examiner* — Seahee Hong
(74) *Attorney, Agent, or Firm* — Renner, Otto, Boisselle & Sklar, LLP

(57) ABSTRACT

The invention relates to a lifting device, especially a mobile lifting device, for lifting loads, vehicles or the like, said lifting device comprising a lifting column (14), a support (21) which is guided by the lifting column (14) and on which a load carrying means (22) can be arranged, and a drive unit (18) which can be controlled via a control unit (17) and which moves the support (21) up and down in relation to the lifting column (14). The support (21) has a sleeve-type or bullet-type shape and surrounds at least part of the lifting column (14).

18 Claims, 14 Drawing Sheets

Figure 1:
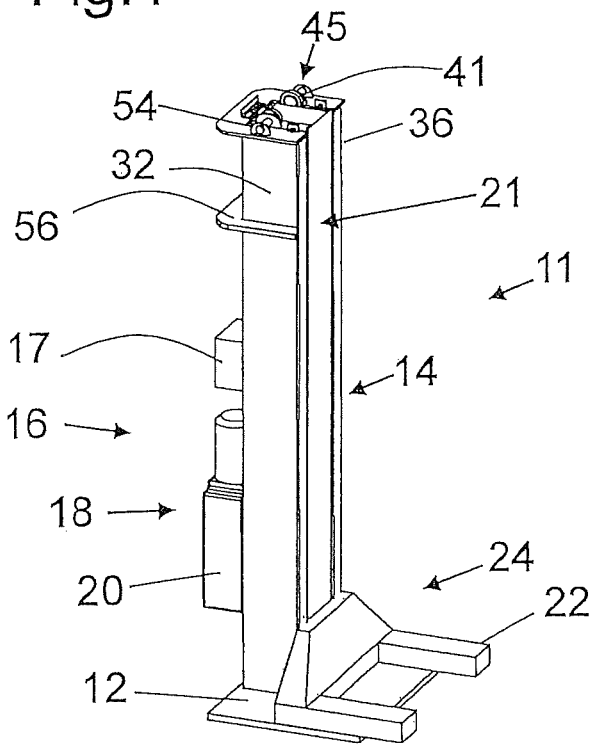

(51) Int. Cl.

| | |
|---|---|
| ***B66F 7/00*** | (2006.01) |
| ***B66F 3/08*** | (2006.01) |
| ***B66F 3/24*** | (2006.01) |
| ***B66F 3/42*** | (2006.01) |
| ***B66F 3/46*** | (2006.01) |

(52) U.S. Cl.
CPC ..... *B66F 3/46* (2013.01); *B66F 7/04* (2013.01); *B66F 3/247* (2013.01); *B66F 7/00* (2013.01)

(58) Field of Classification Search
USPC ..... 254/133 R, 2 B, 7 B, 134, 10 R, 10 B, 254/89 R; 269/17
See application file for complete search history.

(56) References Cited

U.S. PATENT DOCUMENTS 3,647,183 A * 3/1972 Rishovd ..... B66F 3/30 254/2 B
3,666,053 A 5/1972 Tormey
3,757,899 A * 9/1973 Smith, Jr. ..... B66F 9/07 187/224
3,986,702 A * 10/1976 Barber ..... B65D 90/143 254/45
4,174,095 A * 11/1979 Chipman ..... B66F 3/24 254/93 H
4,457,401 A * 7/1984 Taylor ..... B66F 7/04 187/208
4,500,071 A * 2/1985 Bagwell ..... B66F 7/04 254/423
4,505,455 A * 3/1985 Beatty ..... B66F 7/04 254/89 H
4,599,034 A * 7/1986 Kennedy ..... B66F 7/025 254/89 R
4,892,028 A * 1/1990 Stivers ..... B66F 7/04 254/89 H
5,484,134 A * 1/1996 Francis ..... B66F 7/04 254/2 B
5,524,868 A * 6/1996 Decker ..... B66F 3/42 254/93 H
5,711,512 A * 1/1998 Kauffman ..... 254/2 B
5,800,114 A * 9/1998 Secondi ..... B66F 3/46 280/43.23
5,911,408 A * 6/1999 Berends et al. ..... 254/2 B
6,634,461 B1 * 10/2003 Baker ..... B66F 3/46 187/210
7,014,012 B2 * 3/2006 Baker ..... B66F 3/46 187/210
2004/0076501 A1 * 4/2004 McGill et al. ..... 414/607
2012/0032126 A1 * 2/2012 Finkbeiner ..... 254/133 R

FOREIGN PATENT DOCUMENTS

| | | |
|---|---|---|
| EP | 2163505 | 3/2010 |
| WO | 98/30488 A1 | 7/1988 |
| WO | 98/30488 | 7/1998 |

OTHER PUBLICATIONS

International Preliminary Report on Patentability for corresponding International Application No. PCT/EP2010/002020 dated Nov. 1, 2010.
International Preliminary Report on Patentability for corresponding patent application No. PCT/EP2010/002019 dated Nov. 1, 2011.

* cited by examiner

LIFTING DEVICE, PARTICULARLY A MOBILE LIFTING DEVICE

This application claims priority to German Application No. 10 2009 014 951.1 filed on Mar. 30, 2009, which is hereby incorporated by reference.

The invention relates to a lifting device, particularly a mobile lifting device, for lifting loads, vehicles or similar.

A lifting device, which is also denoted a single column platform, is known in WO 98/30488. A lifting device of this type includes a base frame with a lifting column arranged thereon, in which a carrier with a load handling attachment arranged thereon can be moved up and down. A lifting unit is provided for lifting and lowering, which includes at least one control and a hydraulic cylinder, in order to move the load handling attachment up and down. The carrier can be moved by roller guides, which engage on the lateral recesses of the lifting column.

An arrangement of this type has the disadvantage that a greater wall thickness is required for creating sufficient rigidity due to the open profiles used, which requires more effort in production. In addition, constructive measures are taken by additional components, in order to achieve the rigidity in single-column lifting platforms.

The object of the invention is to create a lifting device, which facilitates a constructive design with increased rigidity, particularly using fewer components.

According to the invention, the object is achieved with a lifting device, in which the carrier has a sleeve-shaped or cartridge-shaped design, and at least partly surrounds the lifting column. This embodiment has the advantage that the lifting column dips into the carrier, and the carrier can be moved up and down in relation to the lifting column. It is therefore possible that a simple sleeve-shaped profile or hollow profile can be used for forming the carrier, of which the side walls can be designed to be open or closed, whereby the carrier as such has increased rigidity with a low wall thickness. Simultaneously, it is therefore made possible that the lifting column can also be designed by a quasi-closed profile, of which the side walls or side surfaces can be partly open or completely closed, as required. Through this arrangement, the number of required components for production of the lifting device is reduced. Simultaneously, a weight reduction can also be achieved through this, whereby a saving of material costs is also given in turn. In addition, overall, a lifting device of this type, which is preferably designed as a single column lifting device, can be designed with a narrower lifting column. Furthermore, this gives the advantage that the drive element situated in the lifting column can be protected.

A preferred embodiment of the invention intends that at least one lower guide element is provided on a lower end of the carrier or on the load handling attachment, which guide element is supported on the lifting column, and can be moved with the carrier during a lifting movement, as well as at least one upper guide element being attached on the upper end of the lifting column, which guide element is provided fixed to the carrier, which can be moved up and down, during the lifting movement, and supports the carrier. Due to this separation of the upper and lower guide elements, which up to now were both arranged on the carrier, and were moved together with the carrier in relation to the lifting column, it is now made possible, particularly at the start of the lifting process, that a distance of the respective guide elements to the power intake, corresponding to almost the whole height of the lifting column, is available. A very large lever arm is therefore created, which causes a considerable reduction of the acting forces, particularly during the start of the lifting movement of the carrier. Through this, lower wear and tear can be achieved, since only in an upper end position, a distance of the at least one upper guide element on the lifting column to at least one lower guide element on a carrier is taken, which up to now in most cases corresponds to the distance of two fixedly arranged guide elements on the carrier. A considerable extension of lifespan can be achieved by this reduction of wear and tear.

According to a preferred configuration of the invention, it is intended that the carrier surrounds the lifting column in a lowered position of the load handling attachment, and the lifting column preferably has a profile, which is particularly closed. Through this, in particular, the drive equipment arranged in the lifting column, such as drive spindle or a lifting cylinder can also be protected in an upper lifting end position of the carrier. Due to the configuration of the lifting column, which preferably also has a closed profile, increased rigidity can also be achieved. At the same time, simple production is facilitated by using hollow profiles. The corresponding cross-sectional geometries of hollow profiles of this type are adapted to the application. The wall sections of the lifting columns can comprise individual recesses, but can also be designed with an entire surface.

According to an advantageous further development of the invention, it is intended that at least one lower guide element, provided on the load handling attachment or outside of the lifting column on the carrier, engages on at least one guide surface on the lifting column directed to the load pick up. This alternative configuration can then be provided, if a particularly compact configuration of the lifting column is provided, so that the at least one guide element is to be relocated outside of the lifting column.

According to a preferred configuration of the invention, the drive unit and/or control and/or at least one accumulator are provided on the carrier. By carrying along the drive unit and/or control and/or the at least one accumulator, it can be made possible, in an upper lifting end position of the lifting device, that these partly delicate parts are also positioned outside of the working area of the worker. This embodiment is preferably powered by accumulators, and also has the advantage that the risk of damages is reduced, since the drive unit and control unit are also lifted. Preferably, it is also intended that an operating device is arranged on a base device accommodating the lifting column. This base device can be designed as a screen with a keypad or a touch-screen or similar, in order to give, request and read individual commands. Input signals are preferably forwarded to the control via a wireless connection. Alternatively, a wired data transfer can also take place.

According to a further alternative configuration of the invention, it is intended that the lifting column comprises a cross-section, particularly a U-shaped cross-section, at least partly surrounding the carrier, and a continuous rear wall is given in the region of the lifting section, which comprises at least one guide surface for the at least one guide element arranged on the carrier. If only one guide element is provided on the carrier, a guide surface can be designed in the centre of the rear wall, for example, in order to form a counter-bearing to the at least one further guide element arranged on the upper end of the lifting column.

According to a preferred further development of the alternative configuration of the invention, the at least one lower guide element is provided within the lifting column, which is preferably supported on a guide surface on a profile element in or on the lifting column or on a rear wall of the lifting column. This arrangement facilitates a closed arrangement, so that the moved parts are not accessible from the outside, whereby a compact arrangement can be created.

A further preferred configuration of the alternative embodiment of the invention intends that the at least one upper guide element arranged in a fixed position on the upper end of the lifting column, is directly attached to the lifting column, for example, on the side walls and/or the rear wall.

According to a configuration of the alternative embodiments of the invention, it is intended that the at least one upper guide element arranged in a fixed position on the upper end of the lifting column is directly attached to the lifting column, or is attached to a component group, which can be attached to the upper end of the lifting column. This configuration of the component group has the advantage that the at least one upper guide element can be pre-assembled separately, so that simple completion of the lifting devices is subsequently made possible, by the component group being attached and fixed to the lifting column. In the same way, a simple replacement can take place at a later point in time, whereby the carrier can remain in the lifting column.

The component group advantageously comprises recesses, which at least partly surround frontal end sections of the lifting column. It is preferably intended here that these recesses positively engage on the frontal end sections of the lifting column. Therefore, a reinforcement of the lifting column can be achieved in the upper end region, so that even in an upper end position of the load handling attachment, the preferably U-shaped cross-section of the lifting column remains uninfluenced in its geometry and is reinforced.

According to a further preferred configuration of the invention, it is intended that this component group is designed as a mounting panel, and in secured against lifting in a vertical direction by at least one detachable connection. This arrangement facilitates simple assembly and attachment. For example, a bolted connection or a safety splint or similar can be provided, in order to safeguard the component group attached on the upper end of the lifting column against lifting, and/or to fix in the position of the lifting column. Simultaneously, a simpler and quicker exchange of the component group with the at least one upper guide element arranged thereon is made possible. The exchange can take place in a rest position of the load pick-up position.

The lifting column, preferably at least partly surrounding the carrier, preferably comprises side walls, which can be attached to the rear wall for the formation of the U-shaped cross-section, which comprises an edging or splay on a front side lying opposite the rear wall. Due to this edging or splay, the side walls are reinforced in geometry and distortion for taking the loads during the lifting movement. An expansion of the gap in the lifting column can therefore be prevented. Simultaneously, simple positioning and mounting with the rear wall is made possible due to the configuration of the separate side walls.

According to a further preferred configuration of the invention it is intended that the carrier comprises a closed, particularly sleeve-shaped or tube-shaped cross-section, within which a drive element of the lifting unit is arranged. The geometry of the sleeve-shaped or tube-shaped cross-section can be round, quadratic, rectangular, or can include further geometries or include other profiles. A box structure of the carrier for the lifting column and the simultaneous integration of the drive element, particularly a hydraulic element, can therefore be maintained.

Furthermore, in the region of the upper lifting end position of the carrier, a clamp or locking element is preferably provided on the lifting column, which reinforces the position of the side walls to one another and to the rear wall. In this region of the lifting end position, the distance in each case between the at least one lower guide element on the carrier and the lifting column is the smallest, so the greatest forces occur. Due to the simple addition of a clamp element, the housing of the lifting column, forming a U-shape in the cross-section, can be secured and reinforced in a simple way.

The alternative embodiment preferably intends that the carrier, which is at least partly surrounded by the lifting column, consists of four wall elements arranged at right angles to each other, whereby two opposite-facing wall elements are arranged in an inwardly offset manner opposite the longitudinal edges of both other wall elements. This arrangement enables guide surfaces to be formed in both other wall elements, due to the inward offsetting of the wall elements arranged between them, on which guide surfaces the guide elements in a fixed position on the upper end of the lifting column can engage on the carrier. Preferably, in each case, the pair of rollers engages on the protrusions of the wall elements, which form guide surfaces. These can be designed as running surfaces for rollers or as sliding surfaces for sliding guides. At the same time, additionally, another side guide of the carrier can be given by the wall elements, which are inwardly offset.

Furthermore, it is preferably intended in the embodiment, in which the carrier surrounds the lifting column, that the carrier is designed as a closed sleeve, through means of which the lifting column can be dipped into the carrier. In particular, this arrangement has the advantage that both the lifting column as well as the carrier can be formed on a static, rigid cross-section, so that a closed force flow is given within the cross-section. Increased rigidity and therefore increased load pick up is made possible, along with a reduced use of material.

A further preferred embodiment of the carrier intends that the guide surfaces are arranged at an obtuse or right angle to each other. Through this, during the up and down movement of the carrier and the gliding along on the upper guide elements, an independent centering of the carrier to the lifting column can take place. It is therefore possible that lateral guide elements between the carrier and the lifting column are no longer required. Preferably, the sliding or running surfaces of the guide elements are also arranged in this obtuse or right angle. For example, in the case of rollers, the rotational axes are arranged parallel to the guide surfaces. In the case of sliding elements, the sliding surfaces and the contact surfaces are also preferably arranged in parallel. Alternatively, sliding elements can also be provided, which have a wedge shape between the sliding surface and its support surfaces.

This arrangement of the guide surfaces at an obtuse or right angle to the carrier applies for both alternative embodiments, so those embodiments in which the lifting column at least partly surrounds the carrier, or in which the lifting column dips into the carrier, which thus surrounds the lifting column.

A further preferred configuration of the invention intends that along a movement area of the carrier, within which the at least one lower guide element engages on at least one guide surface of the lifting column, a material is provided for forming the guide surface which is more resistant to wear and tear than in the head area of the lifting column. Due to the separated arrangement of the at least one lower guide element on the carrier and the at least one upper guide element on the lifting column, an upper region, which is determined by the minimal distance of the respective guide elements in an upper lifting end position, can be formed from a material which is less resistant to wear and tear, than the material which is used in lifting devices according to the prior art. A saving of costs can therefore be achieved.

The at least one upper and lower guide element is preferably designed as at least one roller. Rollers, for example, particularly with rolling bearings, can be used here. Alternatively, the at least one guide element can be designed as at least one sliding element. In this way, for example, different pairings of sliding material can be provided.

The lifting device preferably comprises rollers on the carrier, which are assigned to each other in pairs, and rollers on the component group, which are assigned to each other in pairs. In each case, these rollers are preferably arranged lying outside, as far as possible, within the lifting column.

It is preferably intended that the lifting column and/or the carrier are designed as punched and bent parts or as laser bent parts, and the lifting column and/or the carrier are particularly designed as a welded construction. For this purpose, the side walls comprise a latching hole, into which the pins of the rear wall engage, so that at least this connection can be subsequently welded. This facilitates a configuration of the lifting column, which saves material and costs, with a sufficiently rigid construction being given simultaneously.

For securing a sleeve-shaped or cartridge-shaped carrier to the lifting column, a further preferred embodiment includes a locking device, which comprises a controllable, mechanical locking element, which engages in a locking position on a counter-bearing on the lifting column. In the process, this locking device can be moved up and down together with the carrier, and facilitates a secure positioning of the carrier to the lifting column, depending on the working position of the load pick up element after its pick up.

According to a further preferred embodiment of this locking device, the counter-bearing is designed as a perforated plate with several recesses arranged at a regular distance from one another, which plate is held to the load pick up on the upper end of the lifting column with a suspension device, and preferably fixed in position to the lifting column by a detachable connection. This arrangement of a perforated plate and its suspension on the upper end of the lifting column on a suspension device has the advantage that the whole load is picked up in the locking engagement of the locking element of the locking device via the perforated plate or the suspension device, and is passed by the lifting column into the base element. The preferably detachable connections of the counter-bearing to the lifting column serve only for fixing in position and do not take any loads. Through this, the effort involved in production of the counter-bearing, which is usually fixed to the lifting column by a welded connection, is considerably reduced. Above all, the advantage is therefore achieved, that there is no distortion of the lifting column due to heat input. In addition, a simple exchange of the counter-bearing is made possible. Furthermore, this arrangement has the advantage that the perforated plate rests on a closed rear wall of the lifting column, whereby complete breakthroughs are excluded, which in turn have a lower risk of injury.

A further preferred configuration of the locking device intends that the locking element is designed as an L-shape, and is pivotably arranged in an oblong-shaped recess on the carrier. This facilitates a simple mechanical construction, which is robust in use. The recess is preferably assigned to a stiffening element, particularly a U-shaped stiffening element, which is oriented closed in the direction of the load pick-up. Through this, the carrier can basically be formed with the wall strengths for maximal load pick-up, and only the region of the locking device can have a reinforced design, so that in the application of the locking device as a drop device, the load can be securely picked up.

Furthermore, the locking device advantageously includes a control device, particularly a controllable magnetic clamp, which is disconnected from the mains after a travelling movement of the carrier to the lifting column. A control signal, particularly a current feed, can therefore be given by the control for taking an unlocking position and the lock can be converted to an unlocking position. As soon as the control device is disconnected from the mains, the locking element independently adopts a locking position and engages on the counter-bearing.

A further preferred configuration of the invention intends that only guide elements which are supported on the lifting column are provided on the carrier. For example, two or more guide elements can be arranged lying opposite each other on an inside wall section of the carrier, which can be moved along the lifting column, and absorb the forces occurring during lifting and lowering of a load. Alternatively, it can be intended that these guide elements are only provided on the lifting column, so that the carrier can be moved along this on the guide elements arranged on the lifting column. Both sliding elements and support rollers or rollers or similar can be provided as guide elements. When using rollers or support rollers, these have a constant distance from one another, and are fixedly arranged on the carrier or sleeve. When using sliding elements, these can extend partly or completely along the carrier or the lifting column.

Figure 2:
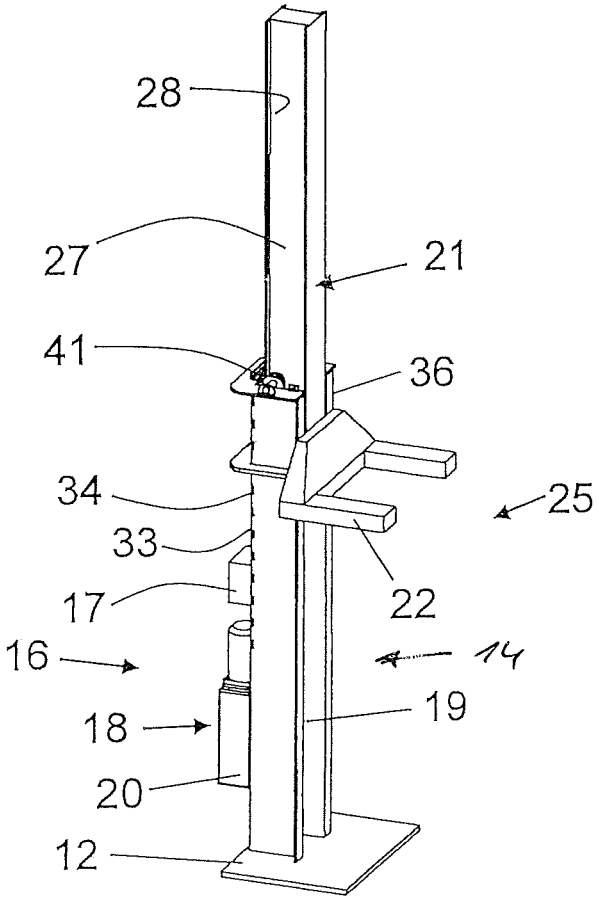
Figure 3:
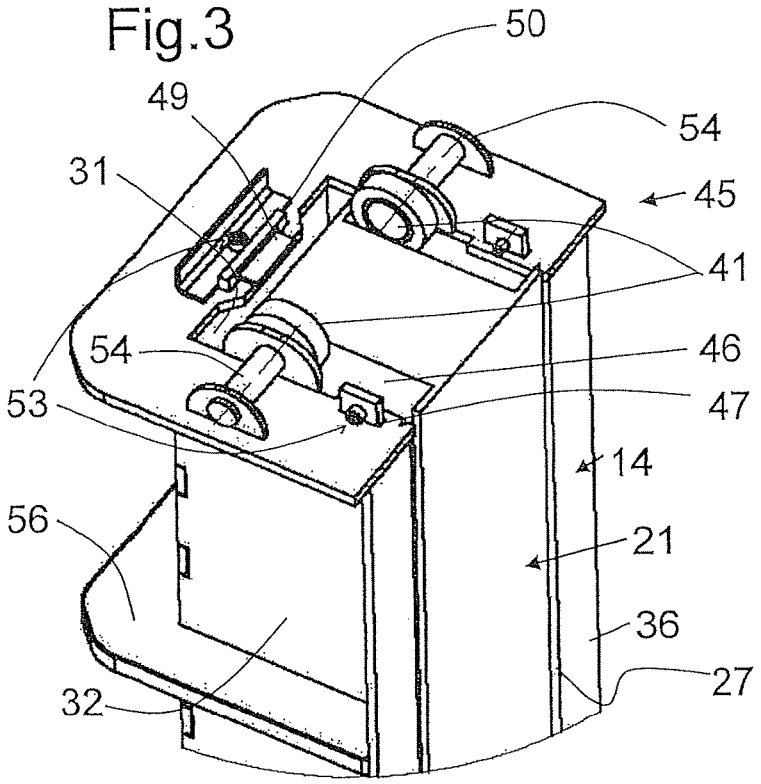
Figure 6:
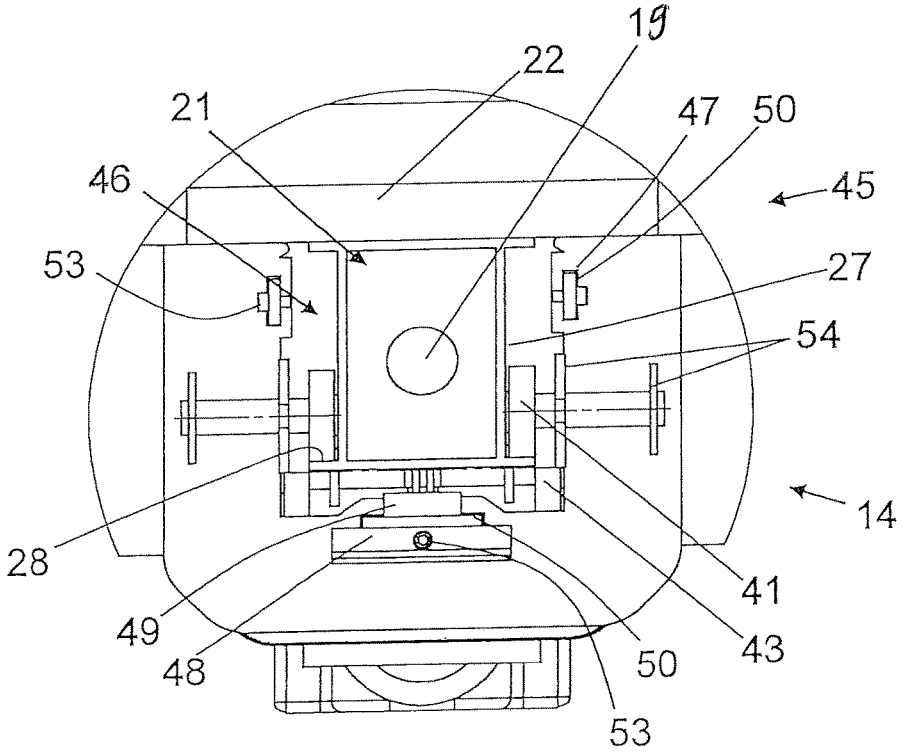
Figure 4:
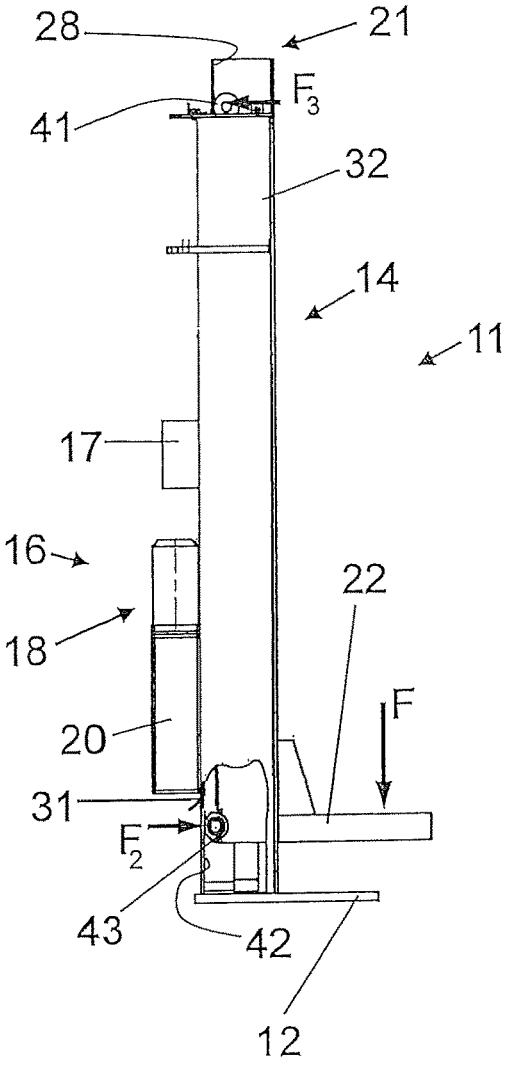
Figure 5:
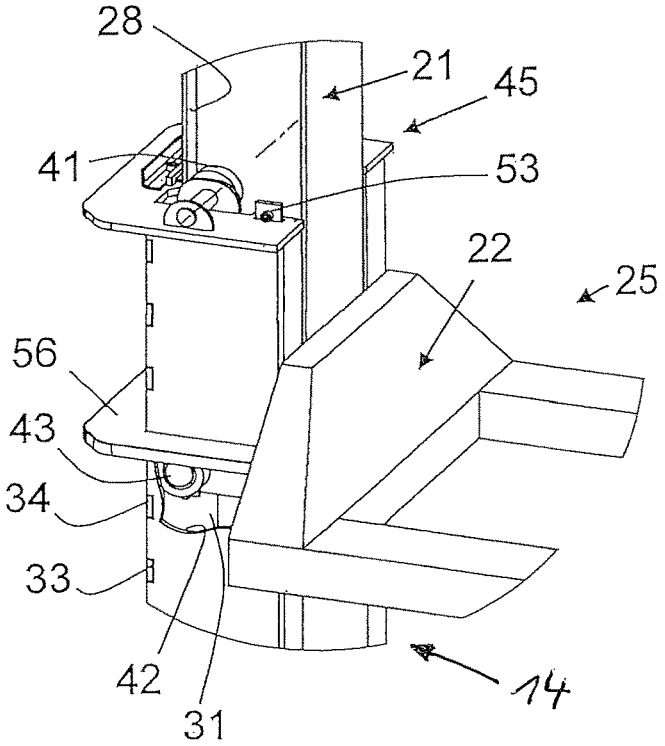
Figure 7:
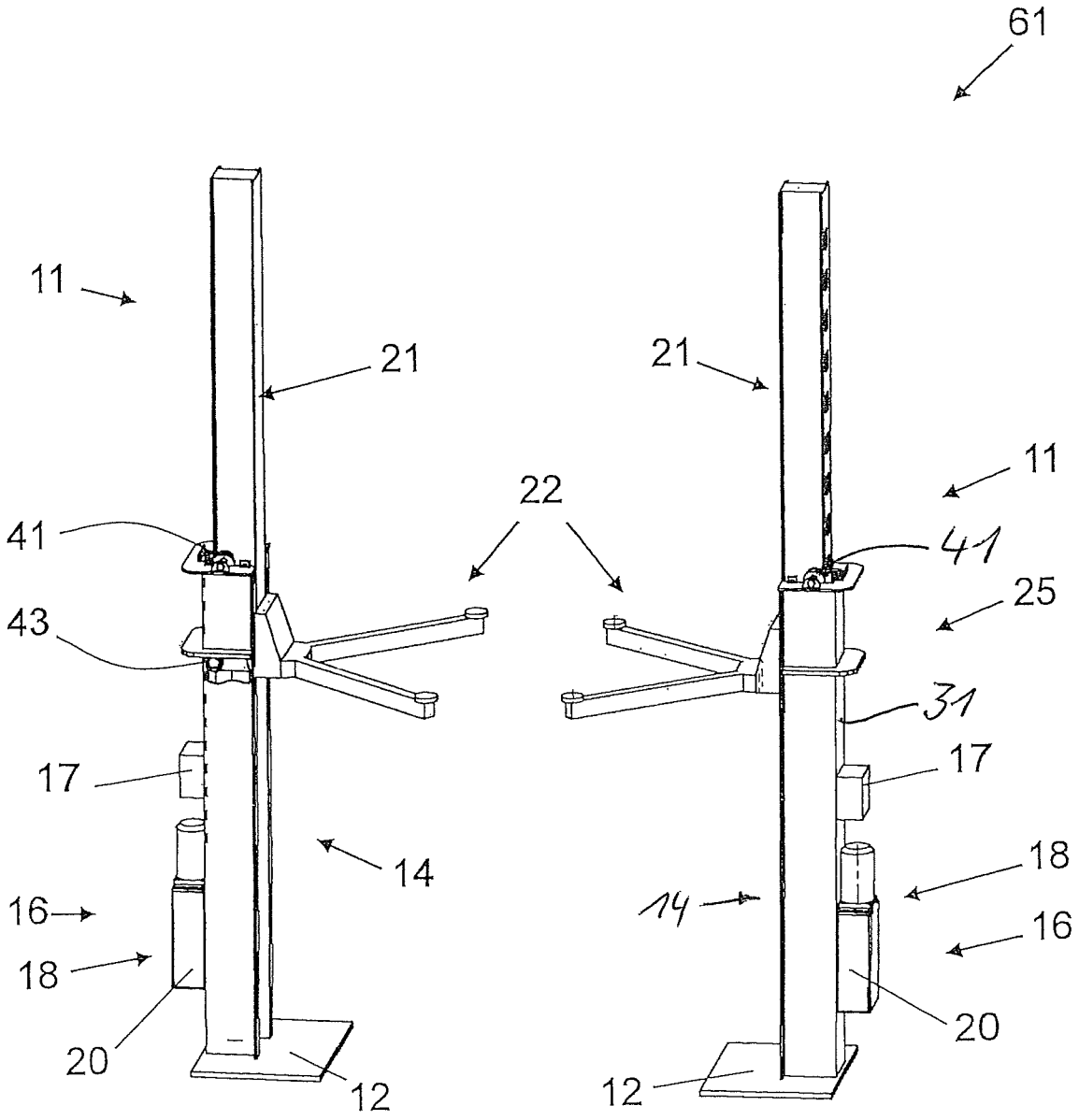
Figure 8A:
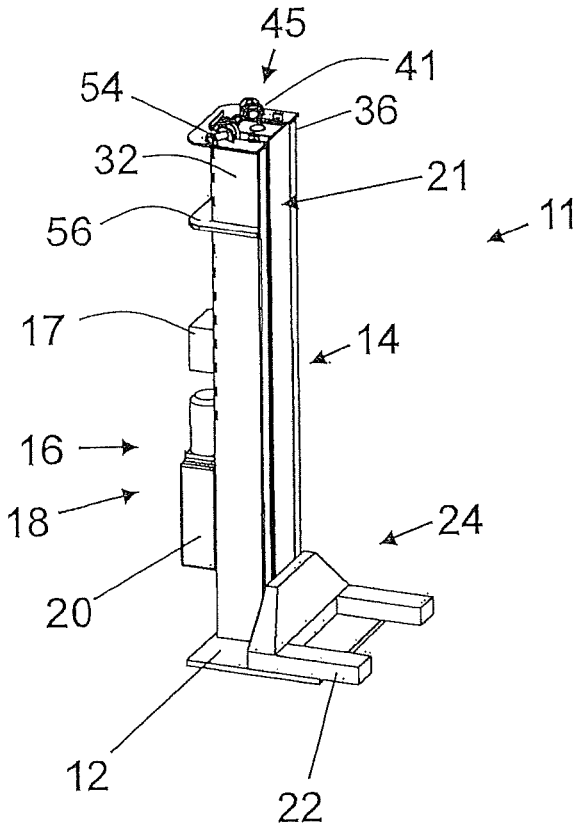
Figure 8B:
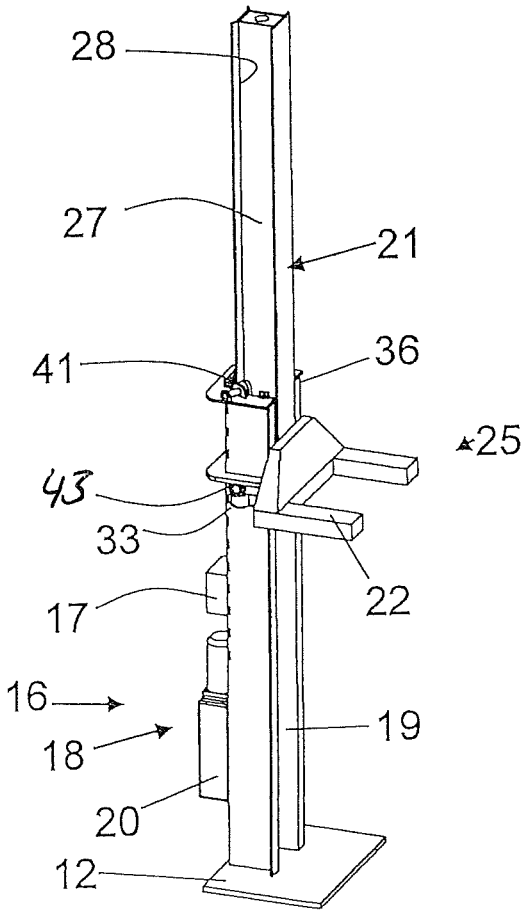
Figure 8C:
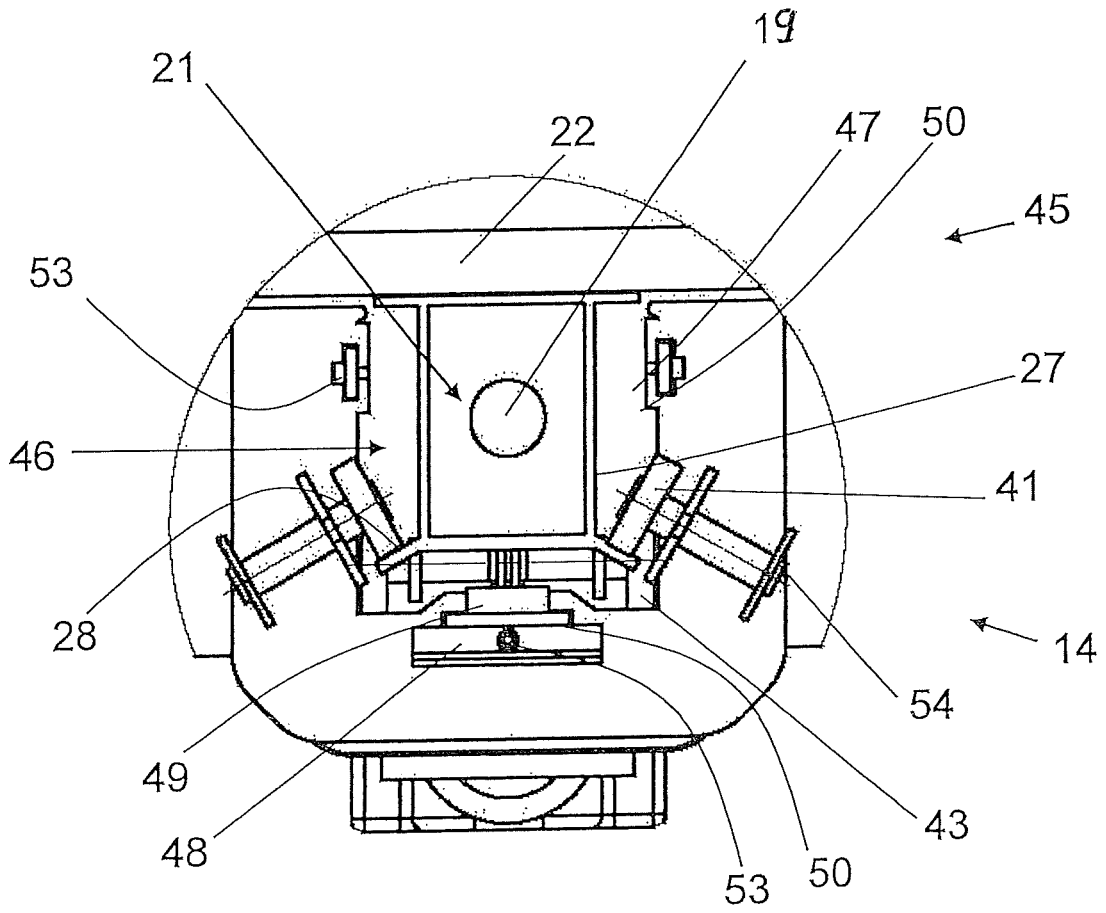
Figure 9A:
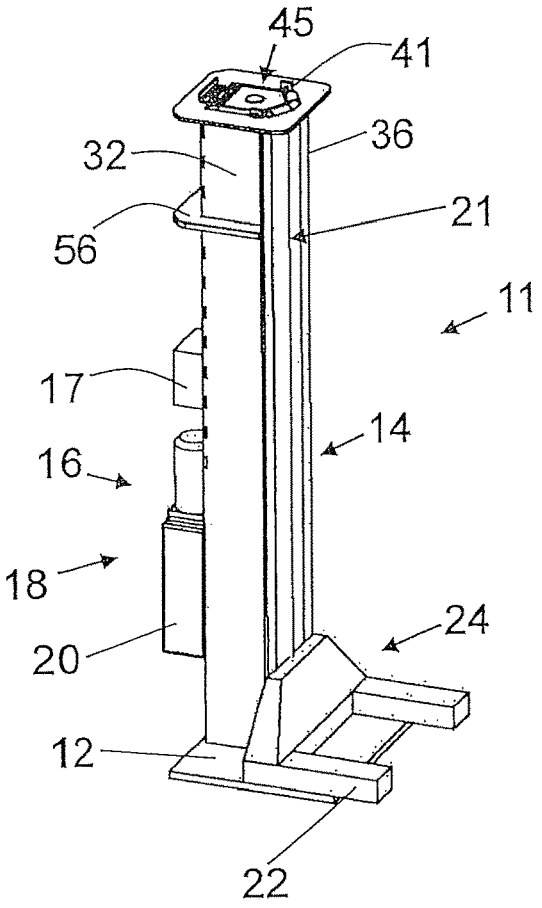
Figure 9B:
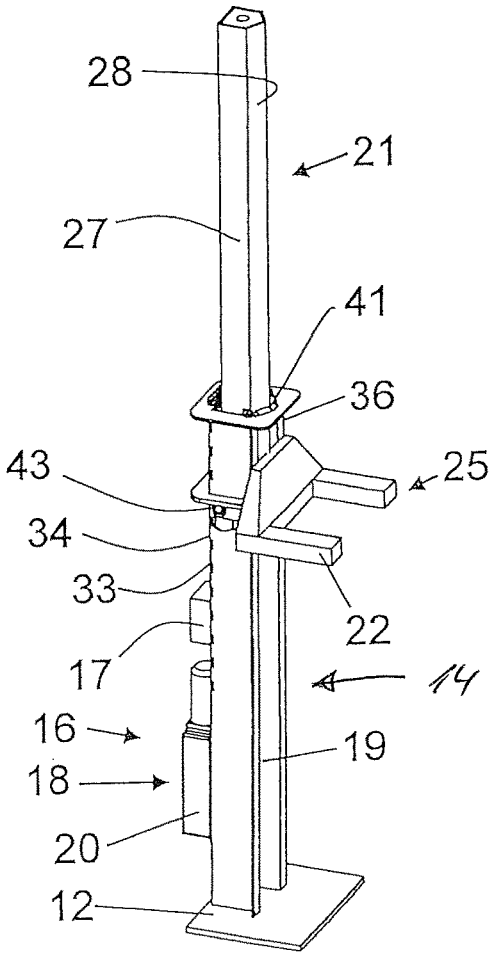
Figure 9C:
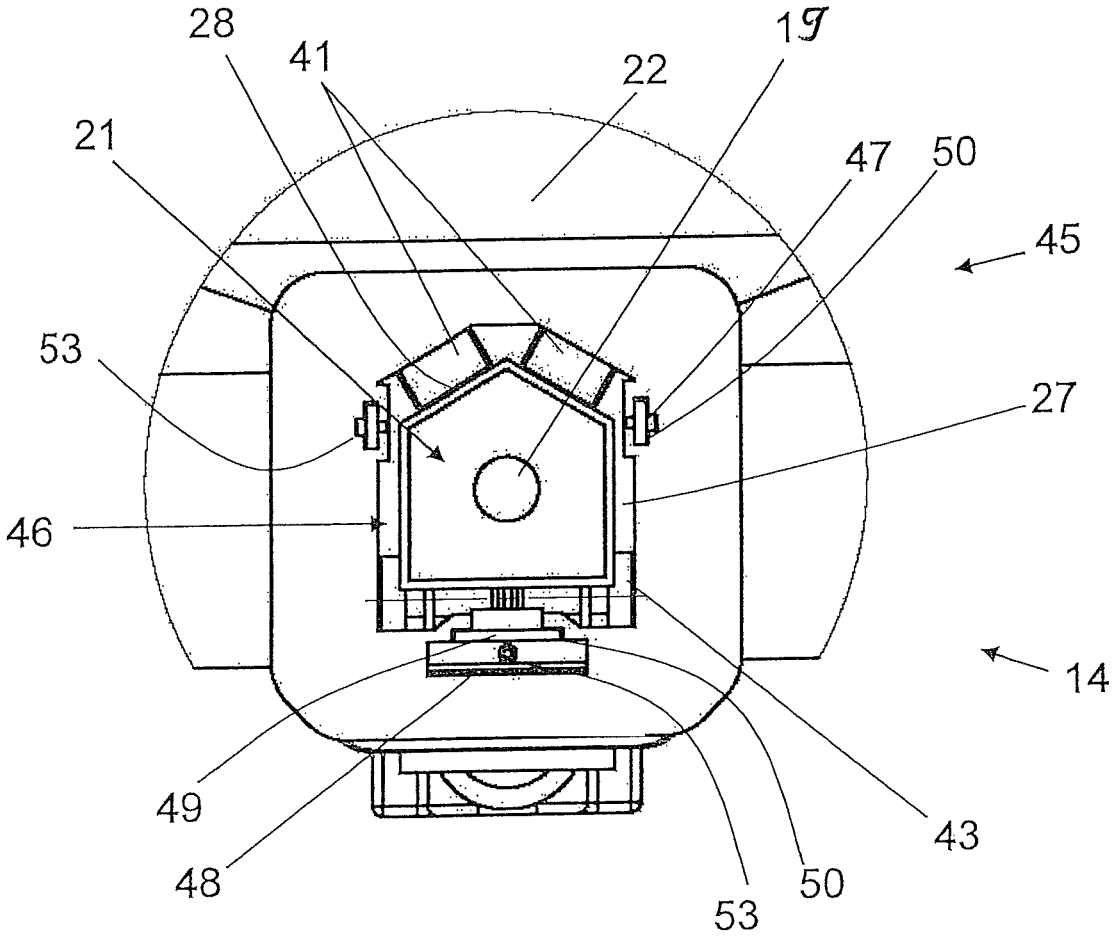
Figure 10A:
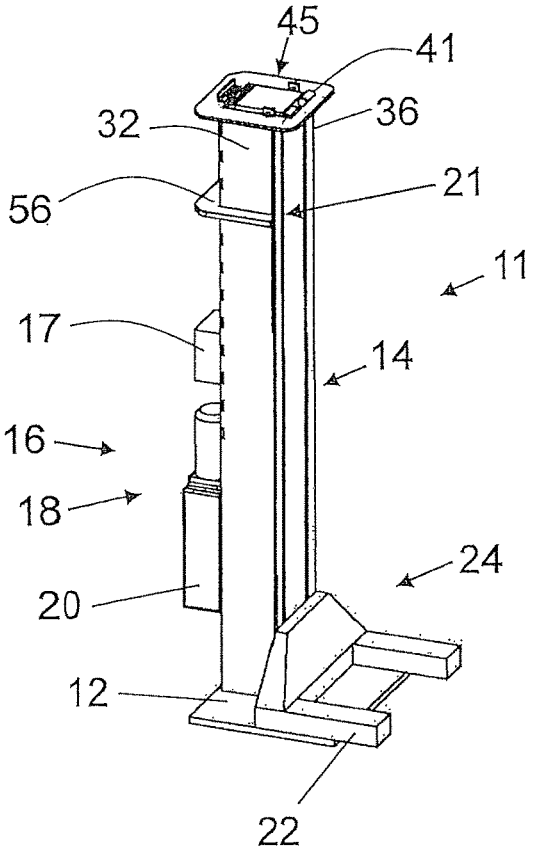

The invention as well as advantageous embodiments and further developments of the same are subsequently explained in more detail and described by means of the examples shown in the drawings. The features to be taken from the description and the drawings can be used individually or in any combination according to the invention. In the drawings:

FIG. 1 shows a perspective view of a lifting device in a rest position,

FIG. 2 shows a perspective view of the lifting device according to FIG. 1 in an upper lifting end position, FIG. 3 shows a perspective view of a component group of the lifting device, FIG. 4 shows a schematic side view of the lifting device according to FIG. 1 for arrangement of the guide elements in a starting position, FIG. 5 shows an enlarged view of the lifting device according to FIG. 4 in an upper lifting end position, FIG. 6 shows a schematic view from above of the embodiment in FIG. 4, FIG. 7 shows a perspective view of a lifting device as a two-column lifting device, FIGS. 8*a, b, c* show different schematic views of an embodiment alternative to FIG. 1, FIGS. 9*a, b, c* show different schematic views of an embodiment alternative to FIG. 1, FIGS. 10*a, b, c* show different schematic views of an embodiment alternative to FIG. 1, FIGS. 11*a* to *d* show schematic views of another embodiment of a lifting device alternative to FIG. 1, FIGS. 12*a* to *d* show a schematic view from above of alternative embodiments of lifting devices according to FIGS. 11*a* to *d*, and FIGS. 13*a* and *b* show a schematic sectional view and perspective view of a locking device of the embodiment according to FIGS. 11*a* to *d*.

A perspective view of a lifting device 11 according to the invention is shown in FIG. 1, which is preferably suitable for mobile use. Lifting devices 11 of this type are also denoted as single column lifting devices 11. The lifting device 11 comprises a base device 12, which is designed as a mobile lifting device 11 according to the execution example of the lifting device 11, and preferably includes a chassis or a steering chassis. Alternatively, the base device 12 can also be designed as a carrier plate or mounting panel, which fixes the lifting device 11 to the floor of a workshop, or in a mobile or stationary working area. For example, on a stationary two column lifting device, a single carrier plate or two separate carrier plates can be provided for attachment to the ground. A lifting column 14 is provided on the base device 12. A lifting unit 16, which includes a control 17 as well as a drive unit 18, is provided on the lifting column 14 or alternatively on the base device or on the base frame 12. This drive unit 18 can have an electro-hydraulic, hydraulic or mechanical design, for example, and drives a spindle drive or similar. This drive unit 18 comprises a hydraulic unit 20 according to this design. A carrier 21 is positioned so that it can move up and down in the lifting column 14. A load handling attachment 22, which according to the execution example is designed as a mobile column element, can be attached to the carrier 21. Through this, the mobile lifting platform together with one or other lifting devices 11 can each engage on a tyre of the vehicle, and lift the vehicle. The individual lifting devices 11, which form a lifting system for lifting vehicles, are connected together by means of supply lines or control lines, not shown in more detail. These supply lines can serve for power supply. Preferably, the lifting devices 11 can be provided independently, which are operated with at least one accumulator 63 (see FIG. 11*a*), which are preferably assigned to the control 17 or the drive unit 18. The controls of the lifting device 11 communicate with each other wirelessly for a simultaneous lifting movement.

The lifting device 11 is arranged in a rest position 24 according to FIG. 1. In FIG. 2, the carrier 21 is extended in relation to the lifting column 14, and the load handling attachment 22 is arranged in an upper lifting end position 25. The lifting device 11 is therefore simple, so not telescopically extendable. The lifting path is determined by the height of the lifting column 14 less the necessary minimum distance between both guide elements 41, 43.

The carrier 21 consists of four wall elements 27, for example, which are arranged at right angles to one another, such as is particularly shown in FIG. 6. Two of the four wall elements 27 are arranged inwardly offset in relation to the longitudinal edges of both other wall elements 27. Through this, guide surfaces 28 develop, which are used for guiding the carrier 21. The wall elements 27 preferably consist of sheet metal parts, which are produced by a punching process or laser cutting process. Subsequently, these individual wall elements 27 are put together, and firmly joined together by a welded connection. Through this, a welded construction, which saves weight and costs, can be formed. Within the carrier 21, a drive spindle 19 or a lifting cylinder is preferably arranged as a drive element 18. The load handling attachment 22 can be fixedly arranged on the carrier 21. Alternatively, a suspension device can also be provided on the carrier 21, so that different load handling attachments 22 can be attached thereon. Furthermore, the lifting columns 14 and the carrier 21 can also be designed with a load handling attachment, not shown in more detail, on the upper front side of the carrier 21, instead of a load handling attachment 22 engaging on the wall element 27.

The lifting column 14 is preferably designed as an essentially U-shaped housing, which is formed of a rear wall 31 and two side walls 32 arranged parallel thereto. Along a longitudinal edge, on which the rear wall 31 engages, the side walls 32 can comprise a latching hole 33, into which engage pins 34 of the rear wall designed according to the contact spacing of the latching hole 33. Through this, the side wall 32 can be positioned on the rear wall 31. The side walls 32 are fixed to the rear wall 31 by subsequent welding. For reinforcement of the side walls 32, the rear wall 31 is provided facing an edging 36 running along the height of the lifting column 14.

Guiding the carrier 21 in the lifting column 14 is done by at least one upper guide element 41 arranged on the carrier 21, as well as by at least one lower guide element 43 arranged in a fixed position on the lifting column 14. Through this, the upper guide element 41 is arranged in a fixed position to the lifting column 14, and the lower guide element 43 passes through a lifting movement in analogy to the travel distances or lifting movement of the carrier 21. Preferably, on the lower end of the carrier 21 within the lifting column 14, a pair of guide elements 41, particularly rollers, are arranged, which engage on guide surfaces 42 in each case, whereby the guide surfaces 42 are formed by the rear wall 31 or by separately attached guide surfaces 42 or as processed or particularly hardened guide surfaces 42 or attached thereon. The arrangement of the upper guide elements 41 on the carrier 21 is disclosed in the schematic sectional representation according to FIG. 4. On the upper end of the lifting column 14, a pair of guide elements 41 is preferably provided, whereby these can be attached either directly to the side walls 32 or these can be attached to a component group 45 according to an advantageous configuration according to FIG. 3.

The component group 45 is preferably designed as a mounting panel or head plate, which can be attached on the upper end of the lifting column 14. It is preferably intended here that the component group 45 comprises a recess 46, which enables the carrier 21 to pass through. Furthermore, the component group 45 preferably comprises recesses 47, in order to positively surround the U-shaped housing. Through this, an expansion of the free side of the U-shaped housing is prevented, whereby an additional stiffening of the lifting column 14 is achieved. The component group 45 preferably lies on a front side of the edging 36, for example. On the rear side, a mounting element or a mounting plate 48 is provided, which accepts the component group on one side, and on the other side includes web-shaped protrusions 49, which engage in oblong-shaped recesses 50. The component group 45 is safeguarded from lifting upwards by form closure and/or by a detachable connection 53, particularly by a bolted connection. In each case, the component group 45 accepts an upper guide element 41 via a bearing 54, which upper guide element engages on the guide surfaces 28 of the carrier 31. This is shown in more detail in FIG. 3 and FIG. 4.

Through this arrangement, in a load pick-up F according to FIG. 4, the load handling attachment 22 causes the lower guide elements 43 to compulsorily engage on the rear wall 21 or the guide surfaces 42 arranged thereon according to the force $F_2$, and the guide elements 28 of the carrier 21 engage on the upper guide element 41 according to the force $F_3$. Due to the lower supporting force $F_2$ and the upper counterforce $F_3$, which act against each other, and the large distance of the upper and lower guide elements 41, 43 at the start of the lifting movement, which essentially corresponds to the height of the lifting column 14, is achieved due to the lever arms, which act in such a way that the forces occurring on the guide surfaces 28, 42 are considerably reduced at the start of the lifting movement and over a large area of the lifting movement.

Near to an upper end, the lifting column 14 comprises a clamp element 56, which is shown in FIGS. 1 to 3. This clamp element 56 is preferably provided at a distance to the upper end of the lifting column 14, in which the lower guide elements 43 engage on the rear wall 31 of the lifting column 14 in an upper lifting end position 25 of the carrier 21. Additional rigidity is given by this clamp element 56. This preferably also concerns a punched part or laser part, which is welded to the lifting column 14. Through this, possible locking forces of a mechanical locking can be passed into the lifting column 14.

The arrangement shown in FIGS. 1 to 4 can also be varied to the effect that instead of rollers, which are designed as guide elements 41, 43, sliding elements can also be used. In the execution example, rollers are used for the upper and lower guide elements. Alternatively, it can be intended that the upper and lower guide elements 41, 43 differ from each other in nature and design. For example, the lower guide elements 43 are designed as rollers and the upper guide elements 41 are designed as sliding elements.

In FIG. 7, a perspective view of a two-column lifting device 61 is shown, which consists of two individual lifting elements 11 according to FIG. 1. In this respect, reference can be made fully to FIGS. 1 to 6. Differently to the embodiment according to FIGS. 1 to 6, the two-column lifting device 61 comprises a load handling attachment 22, which for example is formed by two support arms arranged so that they can pivot to one another. Through this, an adaptation to loading points on a vehicle frame can be made possible. In the same way, a rail can also be incorporated. In each case, both of these lifting devices 11 can be provided separately on a base device 12 or a carrier plate. Alternatively, a common mounting or fastening plate can be provided as a base device 12.

An alternative arrangement of the upper and lower guide elements 41, 43 of the embodiment according to FIG. 4 intends that the lower guide element 43 can be arranged in such a way on the carrier 21 that this runs outside of the lifting column 14. For example, the lower guide element 43 can be supported on the edging 36 of the side walls 32. The upper guide element 41 attached to the lifting column 14 can, in the same way as in FIG. 4, or, as shown for example in FIG. 7, engage on the wall element 27 turned away from the rear wall. In the process, the upper guide element 41 can again be directly arranged on a side wall 32 of the lifting device 14 or on the component group 45.

Figure 10B:
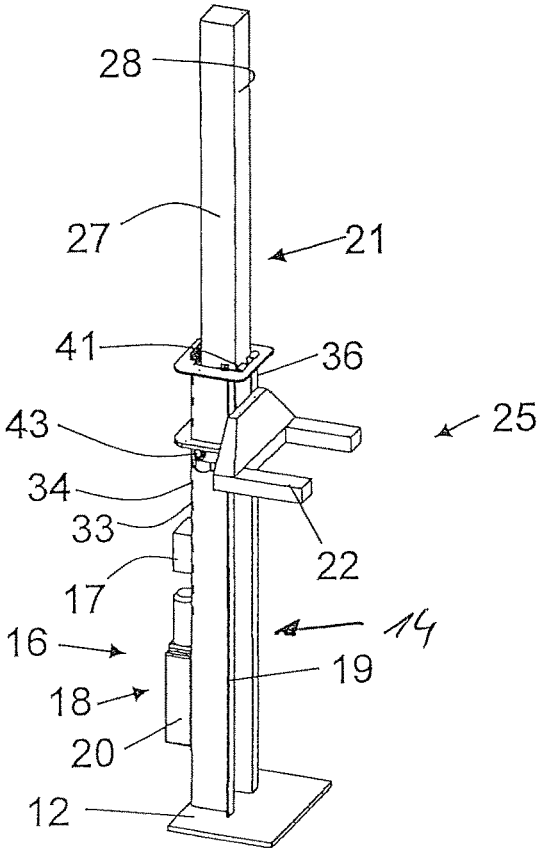
Figure 10C:
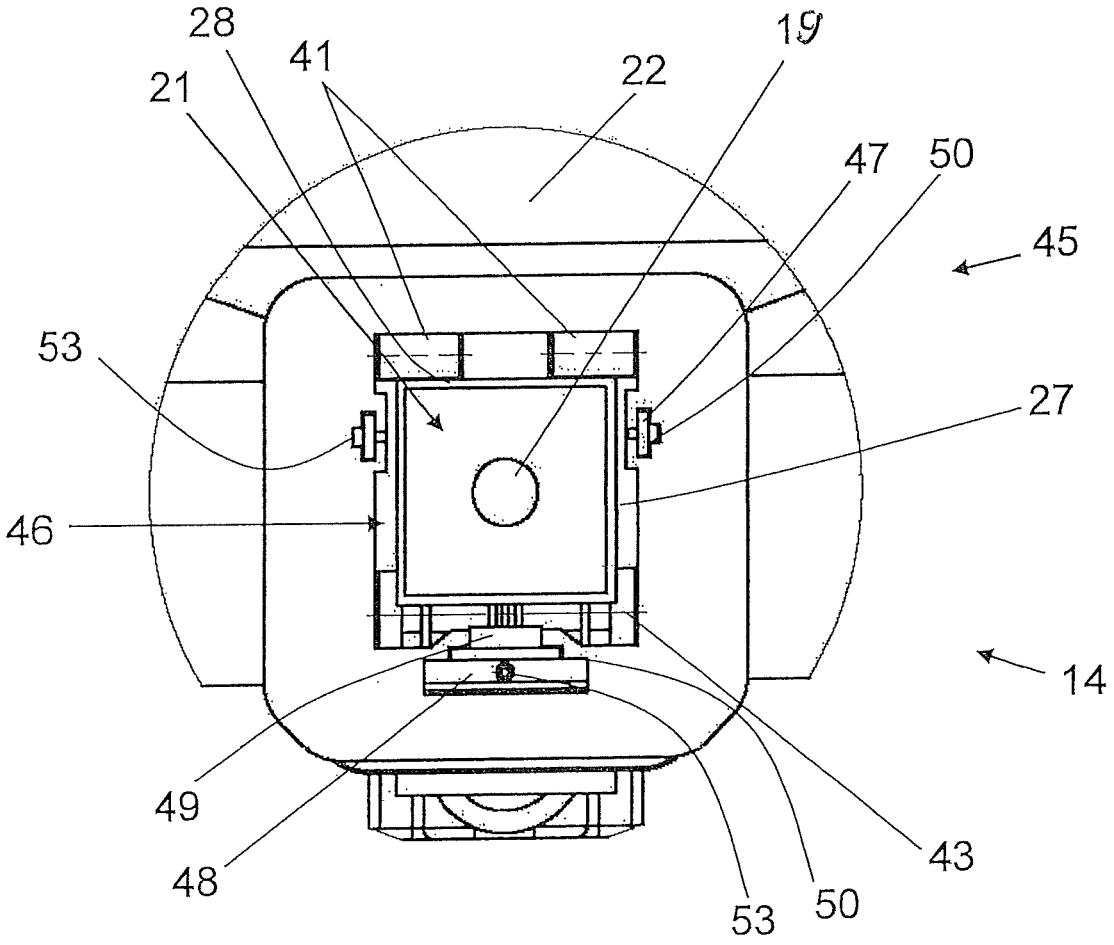

Further schematic views of an alternative embodiment to FIGS. 1 to 6 are shown in FIGS. 8*a, b* and *c*. FIG. 10*a* shows the lifting device 11 in a rest position, FIG. 10*b* shows the load pick-up 22 in an upper lifting end position 25, and FIG. 10*c* shows a view from above of the lifting device 11 according to FIG. 10*a*. This embodiment differs from the embodiment according to FIGS. 1 to 6 to the effect that the guide surfaces 28 and the guide elements 41 engaging thereon do not lie in a common axis, but rather the guide surfaces 28 and therefore also the roller surfaces or sliding surfaces of the guide elements 41 are arranged at an obtuse or right angle to one another. In the process, the obtuse or right angle is oriented in such a way that self-centering guiding is made possible due to the loads occurring during a lifting movement from a rest position 24 to an upper end position 25. Therefore, further guide elements of the carrier 21 to the lifting column 14 can be omitted.

A further embodiment of the lifting device alternative to FIGS. 1 to 6 is shown in FIGS. 9*a, b* and *c*. These upper guide elements 41 are preferably arranged on a component group 45, which includes a centrical recess 46, through which the carrier 21 can pass during its lifting movement. For accepting the counterforce $F_3$, two upper guide elements 41 are preferably provided, which engage on a guide surface 28 of the carrier 21 in each case, whereby both guide surfaces 28 of this carrier 21 are arranged at an obtuse or right angle to one another. In this embodiment, the carrier 21 is designed as a closed, pentagonal tube, whereby both guide elements 28 are arranged in a roof shape to the other side wall surfaces of the carrier 21, which are preferably arranged at right angles to one another. This closed, polygonal profile of the carrier 21 represents an embodiment alternative to the previously named profiles and geometries of the carrier 21.

This configuration has the advantage that in absorption of the counterforce F3, an independent self-centering of the carrier 21 to the upper guide elements 41 takes place. Preferably, these upper guide elements 41 are designed as sliding elements. Alternatively, however, rollers can also be used.

A further alternative embodiment to FIGS. 10*a, b* and *c* is shown in FIGS. 9*a, b* and *c*. This embodiment differs to the extent that the centrical recess 46 is designed as quadratic or rectangular, and the upper guide elements 41 lie in a common axis, instead of being at an obtuse or right angle to one another. Through this, the profile of the carrier 21 or its cross-sectional geometry can be designed as quadratic or rectangular, whereas the carrier 21 according to according to FIGS. 9*a, b* and *c* is designed as a pentagonal profile, for example, in order to arrange the guide surfaces 28 at an obtuse or right angle to one another. Alternatively, it is intended in this embodiment, for example, that the upper guide elements 41 are designed as sliding elements and the lower guide elements 43 are designed as rollers. An arrangement of this type can also be have an inverted design. The mixture of rollers and sliding bearings can be conducted according to the application.

Figure 11A:
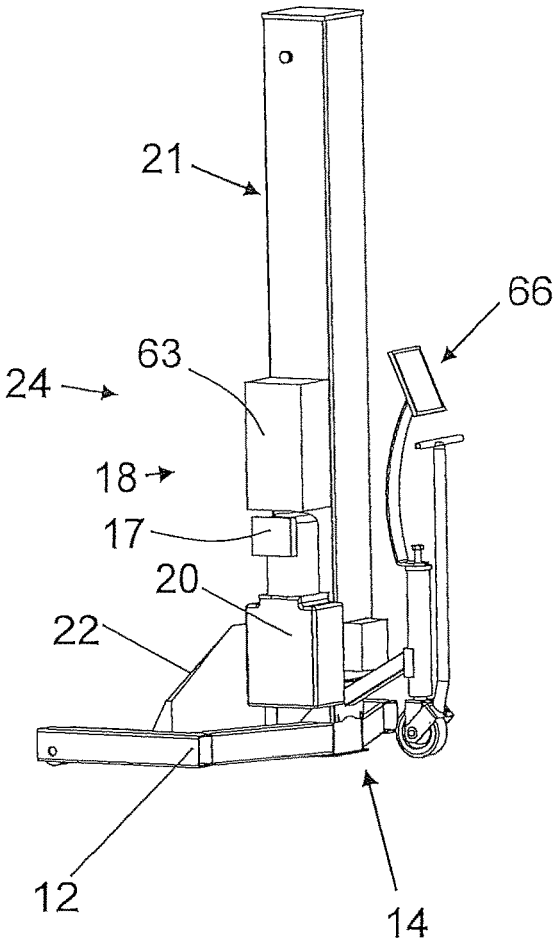

A design of a lifting device 11 alternative to the above-described figures is shown in FIGS. 11*a, b* and *c*. In this embodiment, it is intended that the lifting column 14 is arranged within the carrier 21. This embodiment is almost an inverted arrangement of the existing embodiments. In this embodiment, it is preferably intended that the carrier has a sleeve-shaped or tube-shaped profile, which preferably substantially surrounds the sleeve 14 in a rest position, for example, according to FIG. 11*a*. This embodiment allows the geometry of the lifting column 14 to be designed both as a tube-shaped or sleeve-shaped profile, or also as a closed profile, whereby increased rigidity of the lifting device is given. Through this, closed cross-sections can be created for both the lifting column 14 and the carrier 21, which allow higher force absorption. In addition, the drive spindle or the lifting cylinder is arranged within the carrier 21. The profile geometry for the lifting column 14 and the carrier 21 can be versatile. Furthermore, it is intended that that carrier 21 accommodates the control 17 and the drive unit 18 and preferably accumulators 63, and can be moved up and down. Therefore, the design can be simplified by carrying along the control 17, drive unit 18 and accumulators 63 on the carrier 21, as well as the associated cabling and laying hydraulic cables, if applicable.

Figure 11B:
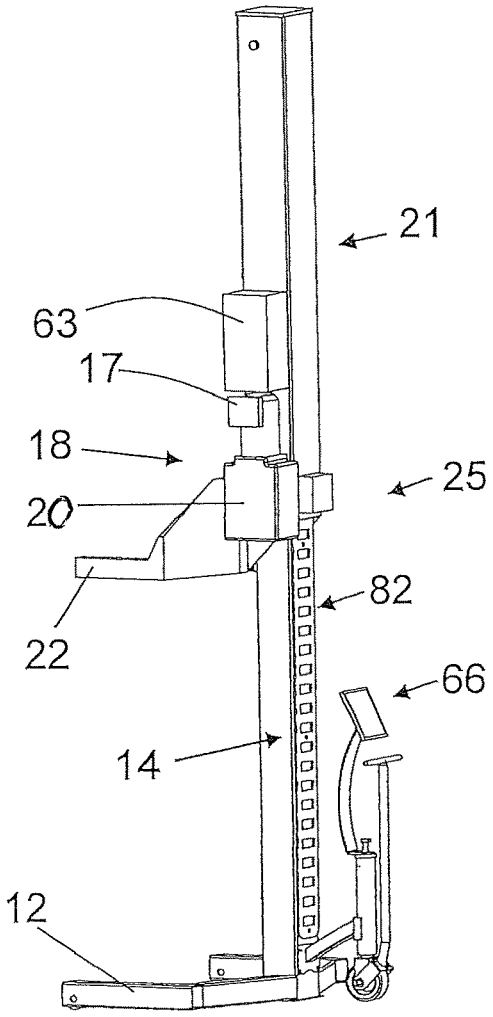
Figure 11C:
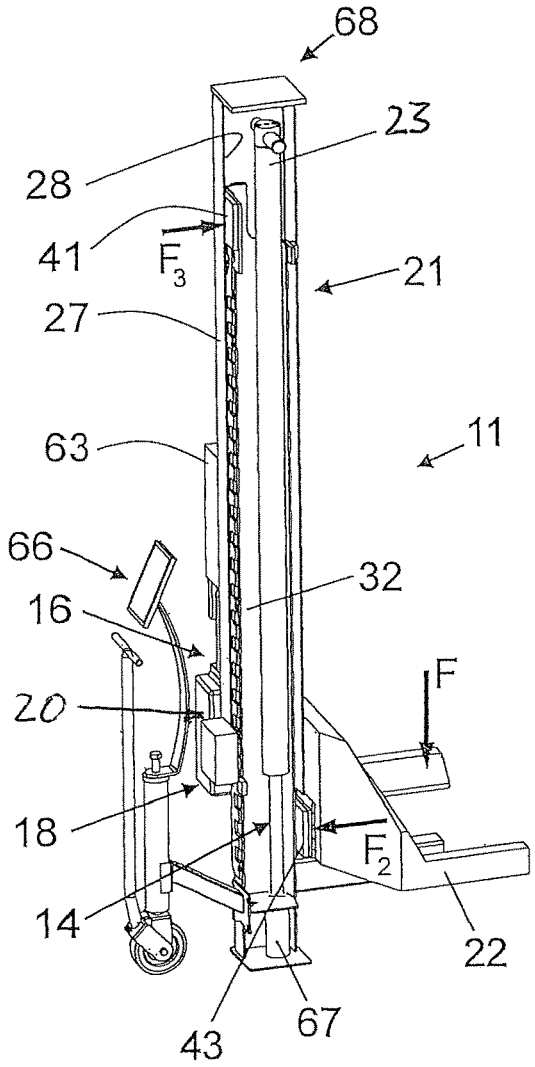
Figure 11D:
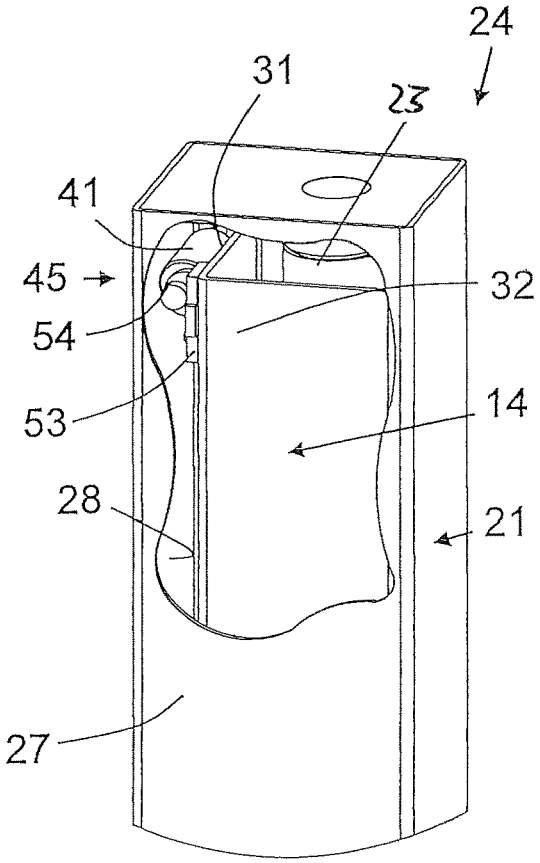

A half-section of the alternative embodiment of the lifting device 11 according to FIGS. 11*a* to *c* is shown enlarged in FIG. 11*d*. A lifting cylinder 23, for example as a drive element 18, is arranged in the lifting column 14 and within the carrier 21. This is therefore not accessible from the outside and is protected. Furthermore, this configuration has the advantage that the upper guide element 41 and the lower guide element 43 are always inside and therefore protected.

It is preferably intended that the control 17, drive unit 18, inclusive of the hydraulic unit 20, and the accumulators 63 are attached to a side wall or to an adapter panel, which can be attached to a side wall of the carrier 21. Alternatively, this unit can also be arranged on the rear wall directed to the operating device 66.

Additionally, in FIG. 11*c*, a spacer 67 is shown for accommodating a lifting cylinder 23. Before the assembly of the cylinder, this spacer 67 is screwed to the free end of the piston rod, or attached thereto. Subsequently, the lifting cylinder 23 is fixed in the carrier 21. The carrier 21 is then put over the lifting column 14, whereby the spacer 67 is introduced into the lifting column 14. Therefore, an independent arrangement and spacing of the free piston end of the lifting cylinder in the lifting column 14 can take place. The spacer 67 is preferably designed similar to a clover leaf, or forming four fingers or a radial shape, particularly a star shape, so that each leaf end or each finger can be supported in a corner of the lifting column 14, which is preferably designed with a quadratic or rectangular form, whereby the engaging fingers comprise a curve, in order to slightly leave out the corner region in the case of a welded lifting column 14. An analogous embodiment also applies for a drive spindle or similar, instead of a lifting cylinder.

In the embodiment according to FIG. 11*c*, the upper and lower guide elements 41, 43 are arranged as sliding members. These can be interchangeably arranged in a simple way with a fastening screw, for example. In FIG. 11*d*, the guide element 41 is designed as a guide roller or roller or supporting roller, alternatively to a sliding member or sliding element.

All internal components, such as, for example, the sensors of the lifting cylinder or the drive spindle, as well as the guide elements 41, 43 can be protected against moisture and/or dirt by the closed embodiment of the carrier 21 with a cover 68 closing the lifting column 14 upwards.

The existing designs in FIGS. 1 to 10*c* apply in the same way for FIGS. 11*a* to *d*, insofar as these can be designed in the inverted arrangement of the carrier 21 and the lifting column 14.

Figure 12A:
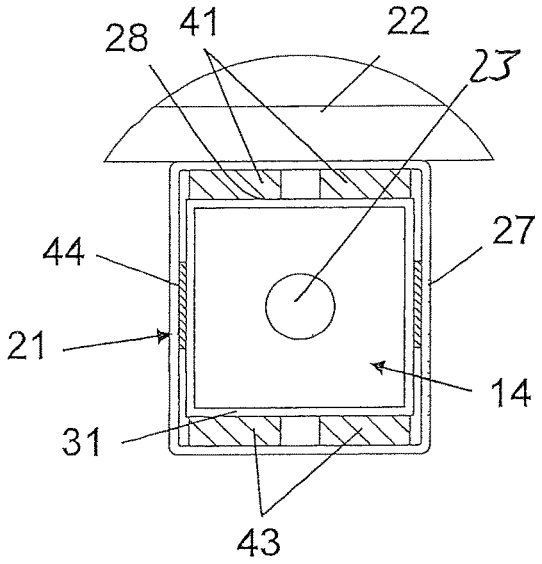

An embodiment of the lifting device 11 alternative to FIGS. 11*a* to *d* is shown in FIG. 12*a*. This embodiment differs from FIGS. 11*a* to *d* to the extent that instead of a continuous upper roll, two rollers or two sliding elements are provided as an upper guide element 41. Furthermore, it is intended that the lower guide elements 43 are designed as sliding elements. This arrangement can also be inverted. Likewise, only rollers or only sliding elements can be provided. Additionally, on the lateral side walls, another guide 44 for lateral positioning of the carrier 21 to the lifting column 14 can be provided, which guide is also preferably designed as a sliding element. These sliding elements, for configuration of the guide 44, can extend in sections or continuously along an inner wall of the carrier 21, or are arranged on an outer wall of the lifting column 14.

Figure 12B:
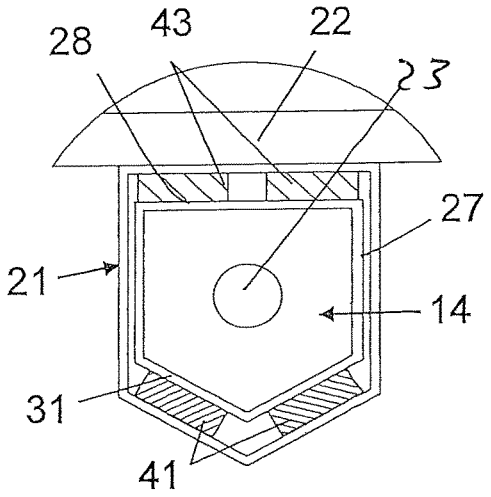

An alternative embodiment to FIG. 12*a* is shown in FIG. 12*b*. This embodiment differs from the embodiment according to FIG. 12*a* as well as from the embodiment according to FIGS. 11*a* to *d* to the extent that the cross-sectional geometries of the lifting column 14 and the carrier 21 are neither quadratic nor rectangular, but a pentagonal geometry, for example, is formed. At the same time, the rear wall 31 of the lifting column 14 is divided into two sections, which are arranged at an obtuse or right angle to one another. Alternatively, a half of a hexagonal or octagonal profile can be provided, whereby the inclined surfaces serve for centering. The same can apply for the corresponding outer surfaces of the carrier 21. Therefore, in turn, a self-centering positioning of the carrier 21 to the lifting device 14 can be given during the up and down movement of the load pick-up 22.

Figure 12C:
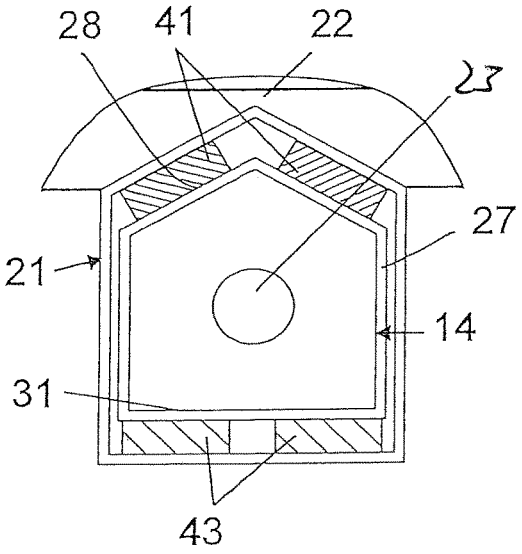

An alternative embodiment to FIG. 12*b* is shown in FIG. 12*c*, whereby in this embodiment, the self-centering guide surfaces are not provided on the rear wall of the lifting column, but rather pointing to the load pick-up 22.

In these embodiments according to FIGS. 12*b* and *c*, the guide elements 41 can be designed both as roller elements or sliding elements, or a combination thereof.

Figure 12D:
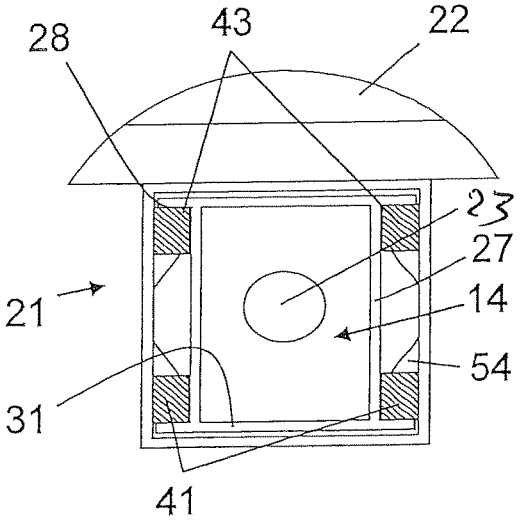

A further alternative embodiment to the abovementioned FIGS. 11*a* to *d* and 12*a* to *c* is shown in FIG. 12*d*. In this embodiment, the lifting column 14 has a cross-sectional geometry like the carrier 21 in the embodiment according to FIGS. 1 to 6. The carrier 21 has a perimeter, which completely surrounds the lifting column 14. At the same time, the upper and lower guide elements 41, 43 are provided respectively on the side walls of the carrier 21, so that these engage on the guide surfaces 28 of the profiled lifting column 14. At the same time, these can be fixed to the carrier 21 by means of fastening elements. Alternatively to the sliding elements, rollers are also possible. The configuration of the profile of the lifting column 14 within the carrier 21 is only as an example. In addition, other profiles designed in other ways, also open ones, can be provided for the lifting column.

Figure 13A:
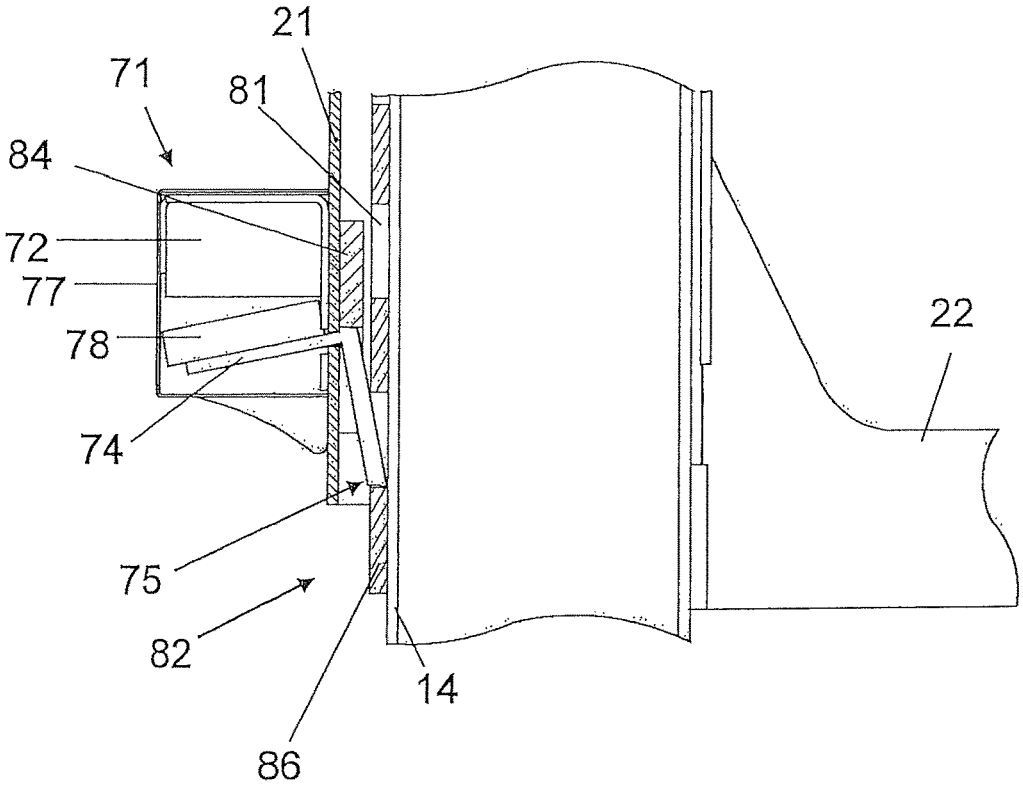
Figure 13B:
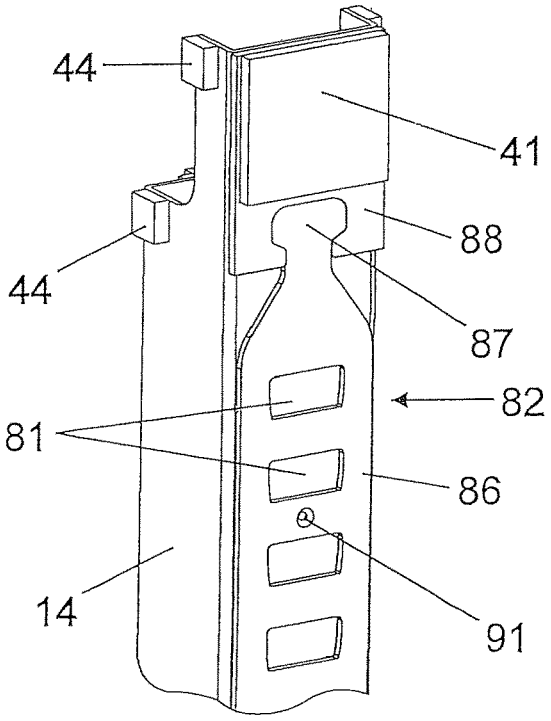

In FIG. 13*a*, a schematic sectional view of a locking device 71 is shown, through which a carrier 21 can be securely held to the lifting column 14 according to an embodiment in FIGS. 11*a* to *d*. FIG. 13*b* shows a perspective view of a part of a locking device 71, which is arranged on the lifting column 14. The locking device 71 includes a control device 72, particularly a magnetic clamp, in order to convert a locking element 74 from the locking position 75 shown in FIG. 13*a* into an unlocking position. The locking element 74 is preferably designed as an L-shaped corner, which is pivotably mounted in an oblong-shaped, preferably rectangular-shaped recess in the carrier 21. One end of the limb of the locking element 74, which is mounted within a housing 77 of the locking device 71, can have a narrower design than the other limb, which engages on the counter-bearing 82 and accommodates a gripping element 78, which is drawn through the control device 72 for unlocking. The second limb of the locking element 74 is arranged between the carrier 21 and the lifting column 14, and engages in a locking position in a recess 81 of a counter-bearing 82. The load acting from above on the carrier 21 is transferred via the recess on the carrier 21 to the locking element 74, and via its limb between the carrier 21 and the lifting column 14, transferred to the recess 81 or into the lifting column 14 via the counter-bearing 82. The recess on the carrier 21 is preferably reinforced with a particularly U-shaped stiffening element 84, whereby the U-shaped stiffening element 84 is designed open towards the bottom, and surrounds the recess on the carrier 21.

According to FIG. 13*b*, the counter-bearing 82 consists of a perforated plate 86 with an anchoring element 87 arranged on the upper end, particularly a button head, which is arranged in a suspension device 88 for load-pick up. The suspension device 88 is fixedly connected to the lifting column 14 for load transfer. When a force is exerted over the locking element 74 onto the recess 81 of the counter-bearing 82, the load pick-up takes place completely via the locking element. The counter-bearing 82 is only fixed in position to the lifting column by a detachable connection 91, particularly a bolted connection. The counter-bearing 82 extends from the upper end of the lifting column 14 to the lower end, in which the load pick-up is arranged in a base position or pick-up position.

In this locking device 71, simply a pivotable arrangement of the L-shaped locking element 74 in the recess on the carrier 21 is sufficient. The gripping element 78 is arranged in such a way that its weight, after the control device 72 is switched off, moves the locking element 74 into a locking position 75. After a lifting movement of the carrier 21, the locking element 74 is independently brought out of the locking position 75. In addition, the control device 72 can still be activated or the gripping element can be powered, so that the locking element 74 can be actively held in an unlocking position during the movement of the carrier. As soon as the control of a lifting movement of the carrier 21 is completed, a deactivation of the control device 72 or a disconnection of the clamping magnet takes place, and the locking device 74 independently engages on the counter-bearing 82, on or in the recess 81.

Owing to the lifting device 11 according to the invention with the above-described embodiments, it is therefore possible that reduced wear and tear is given over almost the total lifting height, due to the increased distance of the upper and lower guide elements 41, 43.

The invention claimed is:

1. A lifting device for lifting loads or vehicles comprising:

a lifting column provided on a base device;

a carrier positioned to move up and down in relation to the lifting column, the carrier having a sleeve-shaped or cartridge-shaped design which at least partly surrounds the lifting column;

a load handling attachment arranged on the carrier;

a drive unit comprising a drive element and a hydraulic unit, the drive element is situated in the lifting column, the drive element being a lifting cylinder; and the hydraulic unit is provided on the carrier;

a control provided on the carrier for moving the carrier up and down in relation to the lifting column, wherein the control is an electronic unit that is configured for wireless communication and communicates with further controls wirelessly for a simultaneous lifting movement of the lifting device; and at least one accumulator provided on the carrier.

2. The lifting device according to claim 1, wherein the carrier surrounds the lifting column in a lowered position of the load handling attachment.

3. The lifting device according to claim 1, wherein at least one lower guide element is provided on a lower end of the carrier or on the load handling attachment, and the lower guide element is moved with the carrier during a lifting movement, and that on an upper end or near to the upper end of the lifting column, at least one upper guide element is provided, wherein the at least one upper guide element is arranged in a fixed position on the upper end of the lifting column during the lifting movement of the carrier, and supports the carrier.

4. The lifting device according to claim 3, wherein the at least one lower guide element provided on the load handling attachment arranged outside of the lifting column on the carrier engages on at least one guide surface of the lifting column pointing to the load handling attachment.

5. The lifting device according to claim 3, wherein the at least one upper and lower guide elements are at least one roller or at least one sliding element.

6. The lifting device according to claim 1, wherein an operating device is arranged on the base device accommodating the lifting column.

7. The lifting device according to claim 1, wherein at least one upper guide element is arranged on an upper end of the lifting column in a fixed position and is directly attached to the lifting column or is provided on a component group attached to the upper end of the lifting column.

8. The lifting device according to claim 1, wherein the carrier comprises a closed cross-section being sleeve-shaped or tube-shaped, and wherein the drive element is arranged therewithin.

9. The lifting device according to claim 1, wherein the carrier surrounding the lifting column is a closed sleeve, permitting the lifting column to dip into the carrier.

10. The lifting device according to claim 1, wherein the carrier comprises guide surfaces, arranged at an obtuse or right angle to one another, and upper guide elements are arranged at the same obtuse or right angle for guiding the carrier on the lifting column.

11. The lifting device according to claim 1, wherein along a movement area of the carrier at least one lower guide element engages on at least one guide surface of the lifting column, a material is provided for forming the at least one guide surface, wherein the material is more resistant to wear and tear than in a head region of the lifting column.

12. The lifting device according to claim 1, wherein on a lower end of the carrier, a locking device is provided, wherein the locking device includes a controllable, mechanical locking element being controlled by a control device, and engages in a locking position on a counter-bearing on the lifting column.

13. The lifting device according to claim 12, wherein the counter-bearing is a perforated plate with several recesses arranged at regular distances from one another, and that the counter-bearing is held at an upper end of the lifting column with a suspension device, and held in a fixed position to the lifting column by at least one detachable connection.

14. The lifting device according to claim 12, wherein the locking element is an L-shaped corner, pivotably mounted in an oblong-shaped recess on the carrier, and the recess on the carrier is fixed with a stiffening element, arranged closed in the direction of the load handling attachment.

15. The lifting device according to claim 12, wherein the control device comprises a clamp magnet provided for unlocking the locking device, wherein the clamp magnet is deactivated after a movement of the carrier in the lifting column.

16. The lifting device according to claim 1, wherein guide elements, supported on the lifting column or on the carrier, are provided on the carrier or on the lifting column.

17. The lifting device according to claim 1, wherein the base device is a mobile lifting device or a mounting panel.

18. A lifting system for raising and lowering a vehicle relative to a surface, the lifting system including at least two lifting devices, each of the lifting devices comprising:

a lifting column provided on a base device;

a carrier positioned to move up and down in relation to the lifting column, the carrier having a sleeve-shaped or cartridge-shaped design which at least partly surrounds the lifting column;

a load handling attachment arranged on the carrier;

a drive unit comprising a drive element and a hydraulic unit, the drive element is situated in the lifting column, the drive element being a lifting cylinder; and the hydraulic unit is provided on the carrier; and a control provided on the carrier for moving the carrier up and down in relation to the lifting column, wherein the control is an electronic unit that is configured for wireless communication, wherein the controls of the two lifting devices communicate wirelessly with each other for a simultaneous lifting movement of the carriers.

* * * * *